US010442218B2

(12) United States Patent
Ogawa et al.

(10) Patent No.: US 10,442,218 B2
(45) Date of Patent: Oct. 15, 2019

(54) PRINTER

(71) Applicant: STAR MICRONICS CO., LTD., Shizuoka-shi (JP)

(72) Inventors: Takeshi Ogawa, Shizuoka (JP); Tadashi Nonaka, Shizuoka (JP)

(73) Assignee: STAR MICRONICS CO., LTD., Shizuoka-Shi (JP)

( * ) Notice: Subject to any disclaimer, the term of this patent is extended or adjusted under 35 U.S.C. 154(b) by 0 days.

(21) Appl. No.: 16/185,142

(22) Filed: Nov. 9, 2018

(65) Prior Publication Data

US 2019/0202218 A1 Jul. 4, 2019

(30) Foreign Application Priority Data

Dec. 28, 2017 (JP) ..... 2017-254923

(51) Int. Cl.

| | |
|---|---|
| ***B41J 11/70*** | (2006.01) |
| ***B41J 2/32*** | (2006.01) |
| ***B26D 1/08*** | (2006.01) |
| ***B26D 5/08*** | (2006.01) |

(52) U.S. Cl.

CPC ..... *B41J 11/70* (2013.01); *B26D 1/085* (2013.01); *B26D 5/08* (2013.01); *B41J 2/32* (2013.01)

(58) Field of Classification Search

CPC . B41J 13/00; B41J 15/04; B41J 15/044; B41J 15/046; B41J 15/00; B41J 11/70; B41J 2/32; G03G 2215/00814; B26D 1/085; B26D 5/08

See application file for complete search history.

(56) References Cited

U.S. PATENT DOCUMENTS

| | | | | |
|---|---|---|---|---|
| 2003/0079585 | A1* | 5/2003 | Carriere | B26D 1/085 83/13 |
| 2012/0027495 | A1* | 2/2012 | Mochida | B41J 11/703 400/621 |
| 2013/0064593 | A1* | 3/2013 | Kosuge | B41J 11/666 400/621 |
| 2016/0185139 | A1 | 6/2016 | Ishida et al. | |

FOREIGN PATENT DOCUMENTS

| | | |
|---|---|---|
| EP | 1095782 A2 | 5/2001 |
| EP | 1095782 A3 | 5/2001 |
| JP | 2001-121764 | 5/2001 |
| JP | 2016-120559 | 7/2016 |
| KR | 101297646 | 8/2013 |

OTHER PUBLICATIONS

EPO, The extended European search report of EP 18206121.8 dated Jun. 21, 2019.

* cited by examiner

*Primary Examiner* — Kristal Feggins
(74) *Attorney, Agent, or Firm* — Lex IP Meister, PLLC

(57) ABSTRACT

A printer provided with a paper cutter apparatus having improved durability and preventing an increase in size of the whole printer is provided. The printer is provided with the paper cutter apparatus having a fixed blade and a drivable movable blade. The printer comprises a body and a swing door openably attached to the body. The fixed blade is provided in the body and the movable blade is provided in the swing door. A driving link is provided in the swing door and coupled to the movable blade. A driving motor as a driving source is provided in the body. A slider is provided in the body. Driving force of the driving motor is conveyed to the driving link via the slider and the movable blade is moved toward the fixed blade by the driving link.

5 Claims, 6 Drawing Sheets

PRINTER

CROSS-REFERENCE TO RELATED APPLICATION

This application claims priority of Japanese Patent Application No. 2017-254923 filed on Dec. 28, 2017. The contents of this application are incorporated herein by reference in their entirety.

BACKGROUND OF THE INVENTION

The present invention relates to a printer provided with a paper cutter apparatus having a fixed blade and a drivable movable blade.

A printer provided with a paper cutter apparatus is well known. In some of the paper cutter apparatuses, paper pulled out from a roll of paper is cut by a drivable movable blade fitted into a fixed blade. In a printer provided with such a paper cutter apparatus, once an error such as a paper jam occurs, the movable blade is locked in an advanced position and prevented from returning to the home position. Generally, the movable blade preferably overlaps the fixed blade on the downstream side thereof in a paper conveying direction. Japanese patent application publication No. 2001-121764 discloses that the movable blade and the driving source thereof are provided in an openable printer cover while the fixed blade is provided in a body. The printer cover can be opened even when the movable blade is locked in the advanced position with overlapping the fixed blade.

Such configuration, however, needs a larger printer cover, resulting in an increase in size of the whole printer.

Japanese patent application publication No. 2016-120559 discloses that the movable blade is provided in the printer cover while the driving source is provided in the body.

Driving force of the driving source is conveyed to the movable blade via a gear. Such configuration prevents an increase in size of the printer cover and the whole printer.

SUMMARY

Such configuration, however, would cause another problem of unintentional collision and abrasion of the gear teeth due to repeated engagement and disengagement whenever the printer cover is closed and opened.

The purpose of the invention is to provide a printer provided with a paper cutter apparatus having improved durability and preventing an increase in size of the whole printer.

A printer provided with a paper cutter apparatus having a fixed blade and a drivable movable blade comprises a body and a swing door openably attached to the body. The movable blade and a driving link coupled to the movable blade are provided in the swing door. The fixed blade, a driving source, and a slider are provided in the body. Driving force of the driving source is conveyed to the driving link via the slider. The movable blade is moved toward the fixed blade by the driving link.

Engagement of the driving link and the slider allows driving force to be conveyed to the driving link. One of the driving link and the slider may be provided with an engagement protrusion and the other may be provided with an engagement hole. The driving link and the slider may be engaged when the protrusion enters the hole. The driving link and the slider may be engaged when the swing door is closed while they may be disengaged when the swing door is opened.

According to the invention, a driving force conveying mechanism using the driving link prevents an increase in size of the whole printer and improves durability of the paper cutter apparatus.

DETAILED DESCRIPTION

Figure 1:
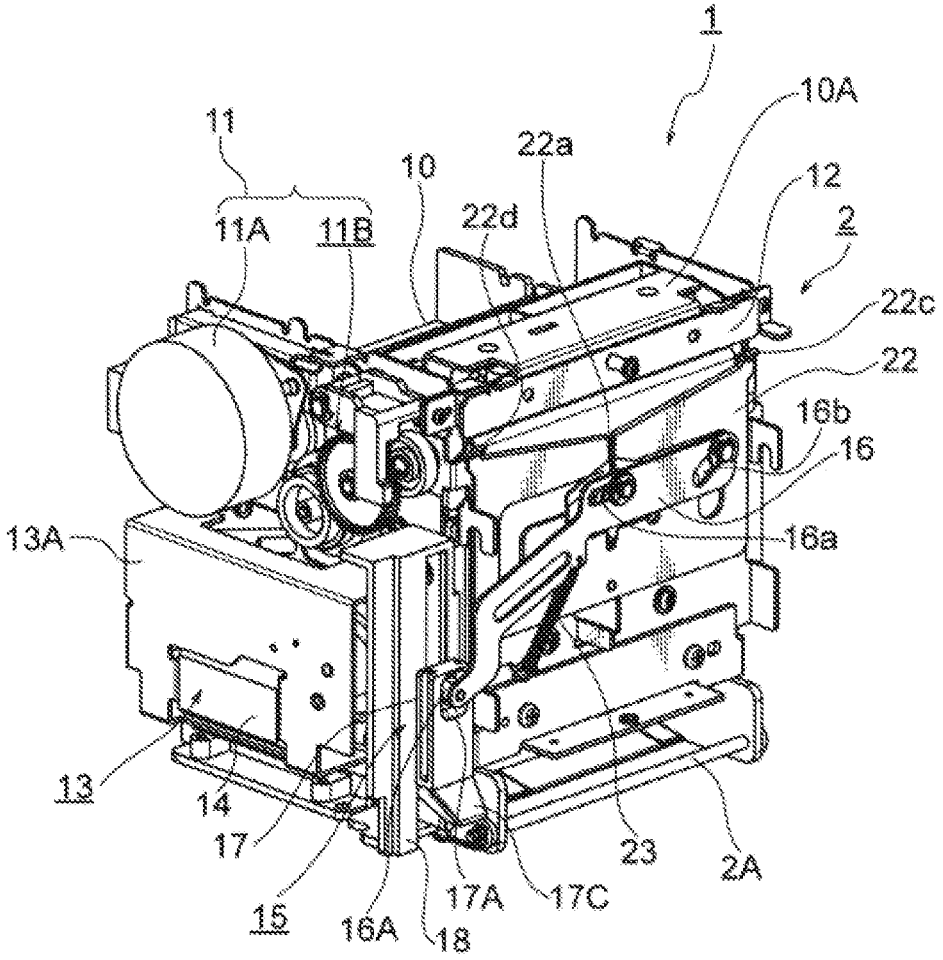
FIG. 1 is a perspective view of a printer provided with a paper cutter apparatus (exclusive of a housing) according to an embodiment of the invention.

Hereinafter, an embodiment of the invention will be described referring to the drawings.

FIG. 1 shows an example of a printer of the invention. The printer may be a thermal printer comprising a body 1 with the front side thereof opened and a swing door 2 attached on the front side of the body 1.

Figure 2:
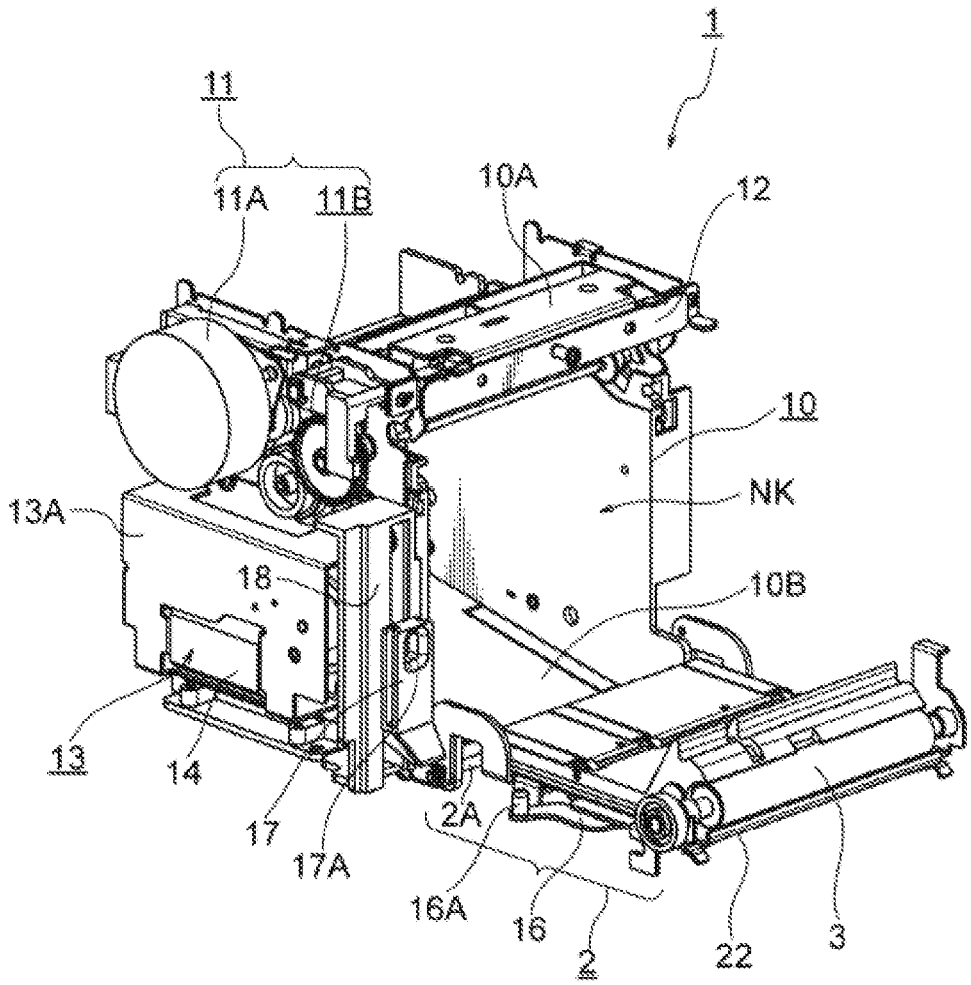
FIG. 2 illustrates a state of the printer of FIG. 1 when a swing door is opened.

The swing door 2 is provided with a platen 3 at the upper end thereof and a pivot shaft 2A at the lower end thereof as shown in FIGS. 1 and 2. The swing door 2 turns outwards on the pivot shaft 2A to be raised and lowered.

The body 1 has an internal space NK for accommodating a roll of paper. The roll of paper is casted into the internal space from the side of the swing door 2. A bottom 10B slightly slopes down to the swing door 2. The roll of paper is positioned nearer the swing door 2 when accommodated in the internal space NK.

The printer is provided with a fixed blade 12 provided in the body 1 and a movable blade 22 provided in the swing door 2 openably attached to the body 1. The printer is further provided with a driving link 16 provided in the swing door 2 to move the movable blade 22 toward the fixed blade 12. The driving link 16 may be coupled with a link driving mechanism 15 having a slider 17 which conveys driving force to the movable blade 22 via the driving link 16. The link driving mechanism 15 is provided in the body 1.

Hereinafter, the body 1 is being fully explained. The body 1 is provided with a frame 10 opened at one end, a printing unit 10A attached at the upper end of the frame 10 to be oriented downwards, a platen driving mechanism 11 operable when the printing unit 10A is activated, the fixed blade 12 mounted on the upper front side of the body 1, and a movable blade driving mechanism 13 mounted in the lower area on the left side (as seen from the front) of the frame 10.

The platen driving mechanism 11 is provided with a platen driving motor 11A and a reduction gear mechanism 11B to feed paper outwards in synchronization with the operation of the platen 3.

Rotational driving force of the platen driving motor 11A is conveyed to the platen 3 via the reduction gear mechanism 11B to perform printing and paper ejection under control of a not-shown control unit.

The movable blade driving mechanism 13 mounted in the lower area on the left wall of the frame 10 is provided with a driving motor 14, a side link driving mechanism 27 (FIG. 5B) which conveys driving force of the driving motor 14 to the link driving mechanism 15. The link driving mechanism 15 further conveys the conveyed driving force to the movable blade 22 on the swing door 2 side.

The link driving mechanism 15 comprises an arm-shape side link plate 19, a slider 17 which conveys driving force to the driving link 16, and a slider guide 18 which restricts reciprocation of the slider 17.

The slider guide 18 is provided on the front side of the left wall of the frame 10 so as to be opposite the left end of the swing door 2. The driving link 16 and the slider 17 may be engaged and disengaged when the door is closed and opened by using a simple structure as described below.

Hereinafter, the movable blade 22 is being fully explained. The movable blade 22 is fitted into the fixed blade 12 from outside for engagement to cooperatively cut paper P discharged from inside.

The movable blade 22 is plate-shaped and the cutting edge thereof engageable with the fixed blade is wide-angle V-shaped. The movable blade 22 is provided with outward bent guides 22*c*, 22*d* at the left and right ends of the cutting edge to smoothly guide the cutting edge toward the outside surface of the fixed blade 12. The movable blade 22 is smoothly raised and lowered by a guide groove 2E of an elevation guide (not shown) provided in the swing door 2.

Figure 3:
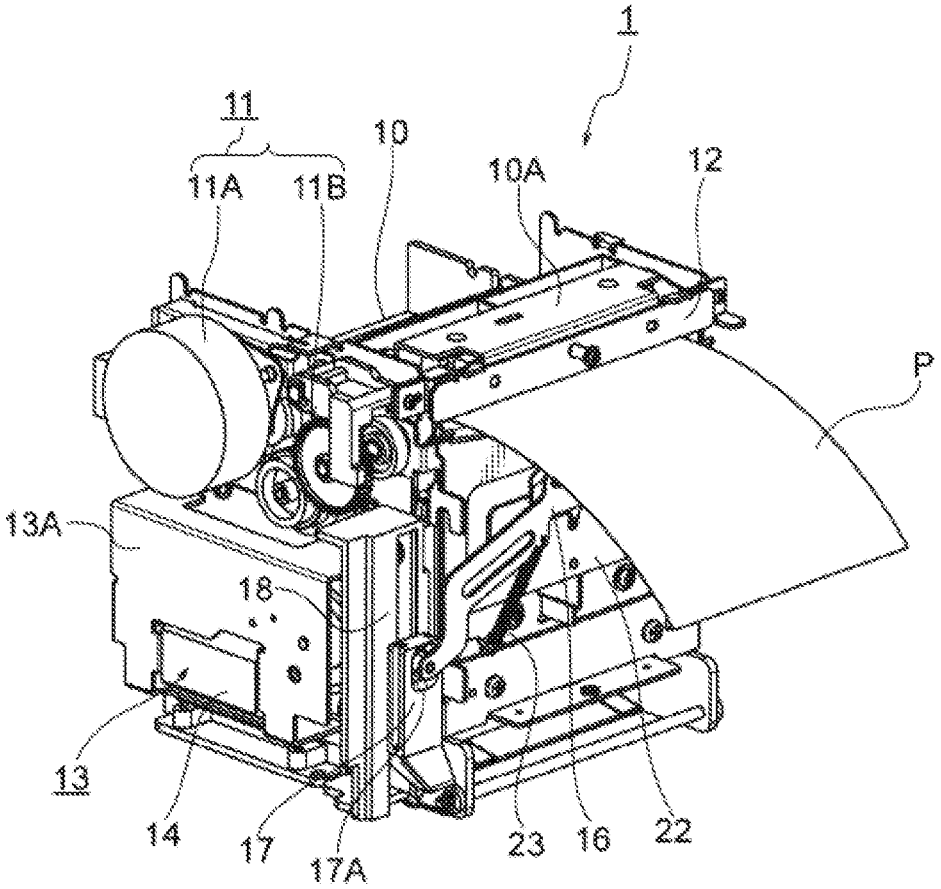
FIG. 3 illustrates a state of the printer of FIG. 1 when paper is ejected.
Figure 4A:
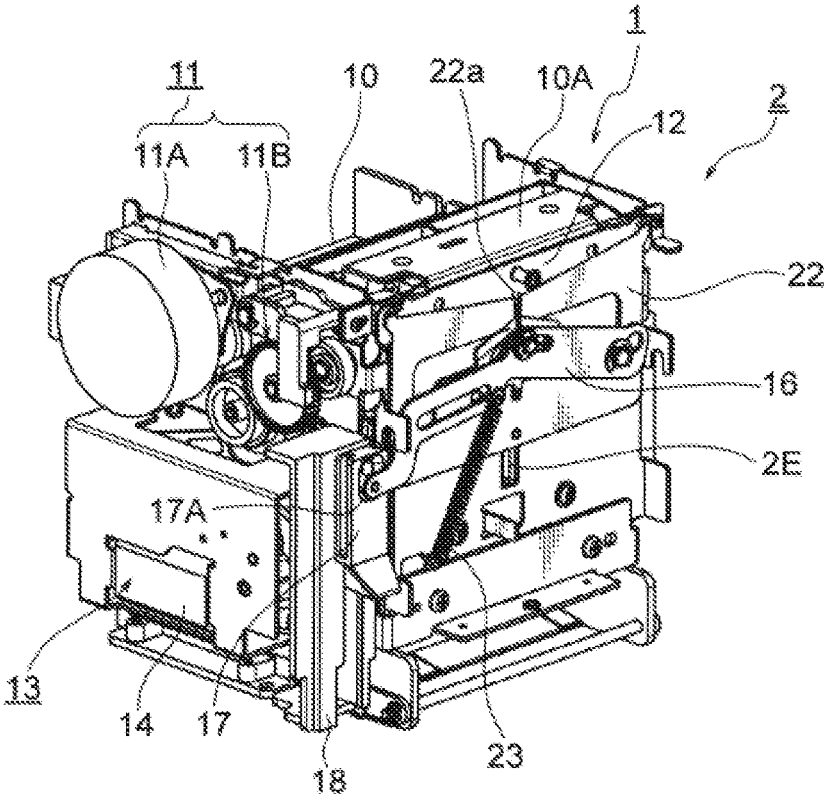
FIG. 4A illustrates a state of the printer of FIG. 1 when a movable blade is brought into engagement with a fixed blade in the uppermost position.
Figure 4B:
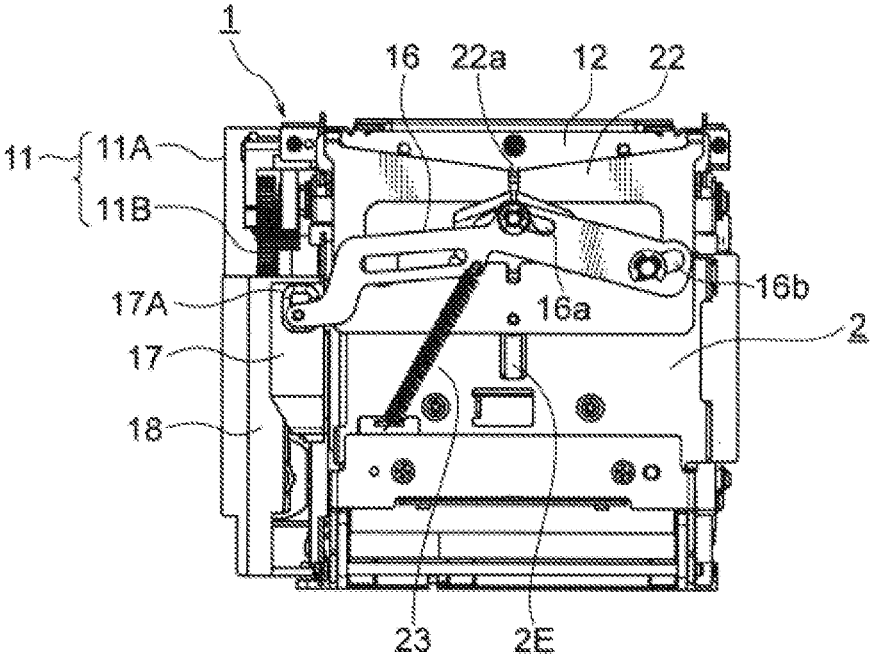
FIG. 4B is a front view of the printer of FIG. 4A.

Accordingly, the movable blade 22 is sure to be fitted into the fixed blade 12 at two spots to cut paper P continuously and smoothly. FIG. 3 illustrates a state of the printer immediately before paper is cut (just when paper is discharged from inside).

The movable blade 22 is further provided with a slit 22*a* in the middle of the cutting edge thereof to left an uncut portion of paper. Cut paper is each partially connected and continuously discharged.

Hereinafter, the driving link 16 is being fully explained. The driving link 16 is provided outside the movable blade 22 to reciprocate the movable blade 22 with respect to the fixed blade 12. The driving link 16 is an arm-shape plate having one end coupled with the movable blade 22 via elongated holes 16*a*, 16*b* provided at two horizontal spots (in the direction perpendicular to the moving direction of the movable blade 22) and the other end detachably engaged with an engagement hole 17A of the slider 17 via an engagement protrusion 16A.

The elongated holes 16*a*, 16*b* are each formed horizontally or diagonally according to the operating direction of the movable blade 22.

The driving link 16 is smoothly engaged with the movable blade 22 via the elongated holes 16*a*, 16*b* vertically wherever the movable blade 22 is. The movable blade 22 is thereby reciprocally moved with respect to the fixed blade 12.

The movable blade 22 is returned to the home position (a lowered position in FIG. 1) by a home position return spring 23. The home position return spring 23 is connected to the driving link 16 to continuously urge the driving link 16 and the movable blade 22 connected thereto downwards. Urging force of the home position return spring 23 is appropriately adjusted so as not to preclude the operation of the slider 17.

The movable blade 22 is reciprocally moved with respect to the fixed blade 12 by the driving link 16 when driving force of the driving motor 14 is conveyed to the driving link 16 on the swing door 2 side via the slider 17 on the body 1 side.

The movable blade 22 is moved toward the fixed blade 12 by the driving link 16 according to vertical movement of the slider 17. Paper P discharged through the platen 3 is instantaneously and uniformly cut from the side edges toward the middle thereof by a smooth cooperation of the movable blade 22 with the fixed blade 12 just like such manner as paper is manually cut from each of the side edges thereof with using scissors.

Figure 5A:
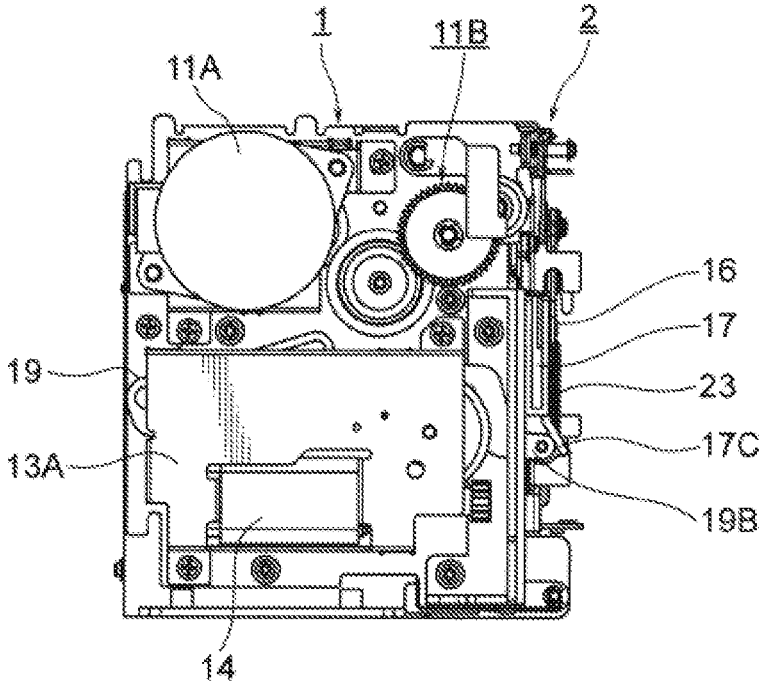
FIG. 5A is a left side view of the printer of FIG. 1 with a protective cover mounted in a lower position.
Figure 5B:
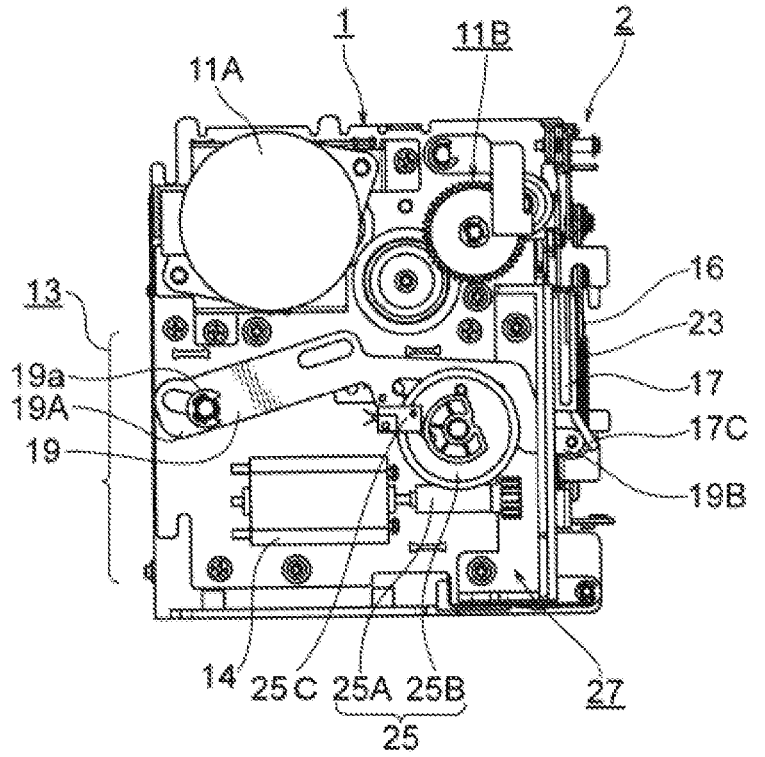
FIG. 5B is a state of the printer of FIG. 5A when the protective cover is removed.
Figure 6:
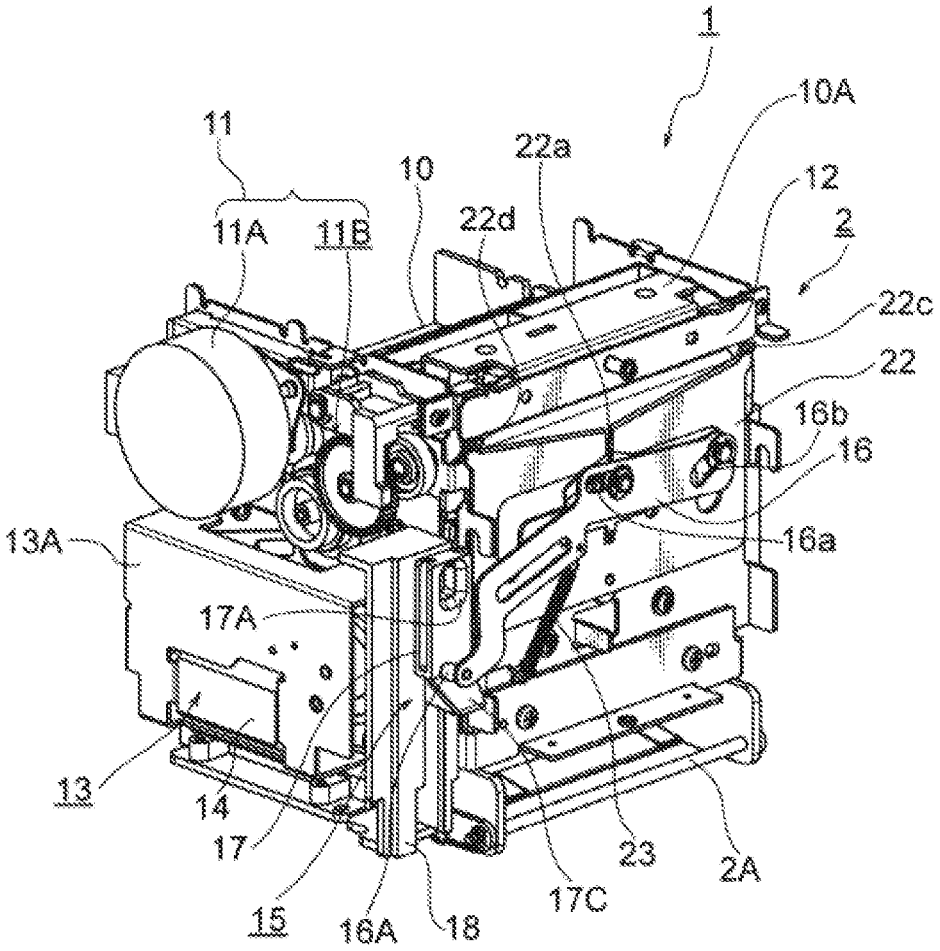
FIG. 6 illustrates a state of the printer of FIG. 1 when the swing door is closed while a slider is raised.

Hereinafter, the movable blade driving mechanism 13 is being described. FIG. 5A illustrates a state of the printer when a side protection cover 13A is put on the movable blade driving mechanism 13. FIG. 5B illustrates a state of the printer when the side protection cover 13A is removed. The movable blade driving mechanism 13 comprises the driving motor 14, the rink driving mechanism 15, and the side link driving mechanism 27. The link driving mechanism 15 comprises the slider 17, the slider guide 18, and the side link plate 19. The side link plate 19 supports the slider 17 from below. The slider 17 is thereby allowed to be vertically moved.

The side link plate 19 is similarly configured as the driving link 16 on the swing door 2 side. The side link plate 19 is provided with a pivot shaft 19*a* at one end 19A nearer the rear surface of the frame 10.

The side link plate 19 turns on the pivot shaft 19*a* at the end 19A so as to move the other end 19B to be raised and lowered. The slider 17 supported by the side link plate 19 is thereby vertically reciprocated.

The side link plate 19 is provided with elongated holes at two longitudinal spots through which the side link plate 19 is coupled to the gear mechanism of the driving mechanism. Driving force of the driving motor 14 is transformed by the gear mechanism to vertical movement of the other end 19B to raise and lower the slider 17.

The side link plate 19 is driven by the driving motor 14 and the side link driving mechanism 27. See FIG. 5B.

The side link driving mechanism 27 comprises a worm gear mechanism 25 and a side link driving member (not shown). The worm gear mechanism 25 comprises a worm 25A and a worm wheel 25B driven by the driving motor 14. The side link driving member is a protrusion integrally formed with the worm wheel 25B. As the worm wheel 25B is rotated, the protrusion is engaged with the elongated hole of the side link plate 19 to raise and lower the other end 19B. Driving force of the driving motor 14 is conveyed to the slider 17 via the worm gear mechanism 25 and the side link plate 19 in this embodiment, but any other conveyance mechanism may be used.

The slider 17 is the shape of a flat rectangle provided with the engagement hole 17A at the upper end and an receiving part 17C at the lower end thereof. There is provided with a connection (not shown) with the side link plate 19 on the back surface of the receiving part 17C. There is further provided with a protrusion (not shown) slidably engagable with the slider guide 18 on the rear surface of the slider 17. The receiving part 17C is a downward inclined surface of a certain size provided at the lower end of the slider 17. The back surface of the receiving part 17C is internally connected to the other end 19B of the side link plate 19. The slider 17 is thereby vertically driven as the other end 19B of the side link plate 19 is raised and lowered. The slider guide 18 is an elongated plate having a linear guide groove extended in the up and down direction to hold and guide the reciprocating slider 17.

Necessary configuration for the printer such as the printing unit, the control unit, and the housing for enclosing them is generally provided.

Hereinafter, the whole operation according to the embodiment is being described. As printing is executed on the body 1 side, paper P is discharged through the platen 3 as shown in FIG. 3.

The control unit provided in the body 1 controls the movable blade driving mechanism 13 to raise the movable blade 22 toward the fixed blade 12 via the slider 17 and the driving link 16. The movable blade 22 is fitted into the fixed blade 12 from outside to cooperate therewith to cut paper P.

First, the movable blade driving mechanism 13 activates the driving motor 14 to convey driving force to the link driving mechanism 15 via the side link driving mechanism 27. Then, the link driving mechanism 15 conveys the driving force to the slider 17 via the side link plate 19. As the slider 17 is raised, the driving link 16 is raised accordingly. Finally, the movable blade 22 connected to the driving link 16 is raised toward the fixed blade 12. Paper P is cut by a smooth co-operation of the movable blade 22 and the fixed blade 12.

In this embodiment, the driving link 16 is raised and lowered according to the up and down movement of the slider 17. The movable blade 22 is raised and lowered according to the up and down movement of the driving link 16. Paper P is cut by a smooth cooperation of the raised movable blade 22 and the fixed blade 12.

The movable blade driving mechanism 13 is controlled by the control unit (not shown) to finally move the movable blade 22 to perform a paper cut operation.

Upon completion of the paper cut operation, the movable blade driving mechanism 13 is again controlled by the control unit to drive the side link plate 19 to lower the slider 17. As the slider 17 is lowered, the driving link 16 and the movable blade 22 are also lowered. When the slider 17 reaches the home position, the side link plate 19 is temporarily stopped until a next instruction is input. The slider 17, the driving link 16, and the movable blade 22 are each stopped at the home position. The state of the slider 17 in engagement with the driving link 16 in the home position is called as a standby state which is ready for a next paper cut operation. A paper cut operation is performed under control of the control unit as required. The driving motor 14 is activated to drive the worm 25A and the worm wheel 25B. As the worm wheel 25B is rotated, the side link plate 19 and slider 17 are each moved in the up and down direction.

The driving force conveying mechanism using the plate-shape driving link 16 contributes to a decrease in size of the paper cutting apparatus and the whole printer.

Hereinafter, the operation of the swing door 2 is being described. As described above, the driving link 16 and the slider 17 are engaged and disengaged according to the operation of the swing door 2. Specifically, when the door 2 is closed, the engagement protrusion 16A of the driving link 16 on the door 2 side is brought into engagement with the engagement hole 17A of the slider 17 on the body 1 side. A protrusion may be provided in the slider 17 while a hole may be provided in the driving link 16. FIGS. 1, 3, 4A and 4B each illustrates the state of the printer when the protrusion is engaged with the hole.

The state of the swing door 2 is detected by a sensor (not shown) and a detection result (whether opened or closed) is sent to the control unit (not shown) on the body 1 side. The position of the slider 17 is detected by a leaf switch 25C connected to the worm wheel 25B and a detection result (whether in the home position) is sent to the control unit on the body 1 side. The sensor is activated during the time the printer is powered on. When it is detected that (1) the swing door 2 is opened and the slider 17 is not in the home position or (2) the slider 17 is not in the home position at power on, the movable blade driving mechanism 13 is activated by the control unit to lower the slider 17 to the home position.

The movable blade 22 and the driving link 16 engaged therewith is urged downwards by the home position return spring 23 connected to the driving link 16. During the time the swing door 2 is closed, the driving link 16 engaged with the slider 17 is moved according to the operation of the slider 17 against urging force of the home position return spring 23. During the time the swing door 2 is opened, the protrusion 16A is released from the hole 17A. The movable blade 22 and the driving link 16 released from the slider 17 is urged to the home position regardless of the operation of the slider 17.

In the standby state, the slider 17 and the driving link 16 are engaged in the home position. When the door 2 is opened, engagement of the driving link 16 with the slider 17 is released. During the time the printer is powered on, the sensors are enabled to detect that the door is opened and the slider 17 is in the home position. During the time the printer is powered off, the sensors are disabled. When the printer is powered on again, the sensors are enabled to detect that the slider 17 is in the home position. Since the slider 17 is detected to be in the home position in either case, there is no need for the control unit to activate the movable driving mechanism 13.

In the non-standby state, the slider 17 and the driving link 16 engaged therewith is not in the home position. For example, when the movable blade 22 is locked in a position other than the home position due to an error such as a paper jam, there is a need for a user to open the swing door 2 to remove the error and restore the standby state.

When the door 2 is opened while the printer is powered on, the driving link 16 is released from the slider 17 to return the driving link 16 and the movable blade 22 engaged therewith to the home position by the home position return spring 23. Simultaneously, the door open and the slider position is detected and the result is sent to the control unit. The movable blade driving mechanism 13 is activated to return the slider 17 to the home position. The driving link 16, the movable blade 22, and the slider 17 are thereby returned to the home position.

A paper jam is removed and then the door 2 is closed. Since the driving link 16, the movable blade 22, and the slider 17 are in the home position, closing the door brings the protrusion 16A of the driving link 16 into engagement with the hole 17A of the slider 17. The printer is thereby returned to the standby state.

When the door 2 is opened after the printer is powered off, the driving link 16 is released from the slider 17 to return the driving link 16 and the movable blade 22 engaged therewith to the home position by the home position return spring 23. The slider 17 is locked in a position upper than the home position.

Since the slider 17 is not in the home position, closing the door never brings the protrusion 16A into engagement with the hole 17A. The protrusion 16A is brought onto the surface of the slider 17. When the printer is powered on, the slider position is detected by the leaf switch 25C. The movable blade driving mechanism 13 is driven by the control unit to move the slider 17 to the home position. As the slider 17 is lowered, the hole 17A is lowered until the protrusion 16A enters the hole 17A for engagement. The printer is thereby returned to the standby state.

As described above, in the embodiment, the driving link 16 used to convey driving force features an easy and simple engagement structure using the protrusion 16A and the hole 17A and thereby improves durability of the paper cutter apparatus. Closing/opening the swing door 2 automatically engage/disengage the slider 17 and the driving link 16. The slider 17 and the driving link 16 with the movable blade 22 restores the standby state after the door 2 is opened and closed. There is no need for the user to directly operate the mechanism, which provides superior operability and maintainability.

The driving force conveying mechanism using the driving link 16 instead of the gear prevents an increase in size of the paper cutter apparatus and the whole printer and further improves durability of the paper cutter apparatus. The invention provides a printer capable of easily restoring the standby state. The invention provides a printer having superior operability and maintainability.

The invention can be also summarized as follows.

A printer provided with a paper cutter apparatus comprises a fixed blade provided in a body and a movable blade provided in a swing door openably attached to the body. The printer further comprises a driving link provided in the swing door to move the movable blade toward the fixed blade; and a link driving mechanism provided in the body and detachably coupled to the driving link. The link driving mechanism comprises a slider to convey driving force to the driving link to move the movable blade.

The driving link comprises a base part, a middle part, and a leading part. The driving link is coupled to the slider at the base part and drives the movable blade in the middle part thereof.

The driving link is detachably engaged with the slider at the base part. The driving link is coupled to the movable blade in the middle part and at the leading part.

The driving link is engaged with the slider at the base part when the swing door is closed. The driving link is released from the slider at the base part when the swing door is opened.

The printer provided with the paper cutter apparatus according to the invention features less occupied space and higher durability and operability, which is useful for every merchandiser who issues a receipt, a ticket, and a label.

What is claimed is:

1. A printer provided with a paper cutter apparatus having a fixed blade and a drivable movable blade, comprising:

a body and a swing door openably attached to the body, the fixed blade being provided in the body and the movable blade being provided in the swing door;

a driving link provided in the swing door and coupled to the movable blade;

a driving source provided in the body; and a slider provided in the body;

wherein driving force of the driving source is conveyed to the driving link via the slider and the movable blade is moved toward the fixed blade by the driving link.

2. The printer of claim 1, wherein the driving force is conveyed to the driving link when the driving link is engaged with the slider.

3. The printer of claim 2, wherein one of the driving link and the slider is provided with an engagement protrusion and the other is provided with an engagement hole, and the driving link is engaged with the slider when the protrusion enters the hole.

4. The printer of claim 2, wherein the driving link is engaged with the slider when the swing door is closed, and the driving link is released from the slider when the swing door is opened.

5. The printer of claim 3, wherein the driving link is engaged with the slider when the swing door is closed, and the driving link is released from the slider when the swing door is opened.

* * * * *